US009748035B2

(12) United States Patent
Duwel et al.

(10) Patent No.: US 9,748,035 B2
(45) Date of Patent: Aug. 29, 2017

(54) METHODS FOR FORMING CHIP-SCALE ELECTRICAL COMPONENTS

(71) Applicant: The Charles Stark Draper Laboratory, Inc., Cambridge, MA (US)

(72) Inventors: Amy Duwel, Cambridge, MA (US); Joshua Nation, Cambridge, MA (US); Jason O. Fiering, Boston, MA (US); Doug White, Lexington, MA (US)

(73) Assignee: THE CHARLES STARK DRAPER LABORATORY, INC., Cambridge, MA (US)

( * ) Notice: Subject to any disclaimer, the term of this patent is extended or adjusted under 35 U.S.C. 154(b) by 260 days.

(21) Appl. No.: 14/482,874

(22) Filed: Sep. 10, 2014

(65) Prior Publication Data

US 2015/0070123 A1 Mar. 12, 2015

Related U.S. Application Data

(60) Provisional application No. 61/876,170, filed on Sep. 10, 2013.

(51) Int. Cl.

| | |
|---|---|
| ***H01F 7/06*** | (2006.01) |
| ***H01F 27/28*** | (2006.01) |
| ***H01F 27/29*** | (2006.01) |
| ***H01F 41/04*** | (2006.01) |

(Continued)

(52) U.S. Cl.

CPC ..... *H01F 27/2823* (2013.01); *H01B 13/06* (2013.01); *H01F 5/04* (2013.01); *H01F 27/292* (2013.01); *H01F 41/04* (2013.01); *Y10T 29/4902* (2015.01)

(58) Field of Classification Search

CPC ..... Y10T 29/49016; Y10T 29/49117; Y10T 156/10; Y10T 29/49018; Y10T 29/49124; Y10T 29/4902; H05K 3/103; H05K 2201/10287; H05K 13/06

USPC .... 29/602.1, 33 M, 600, 729, 739, 748, 753, 29/755, 827, 829, 843, 845, 857; 343/791, 792; 430/5, 22

See application file for complete search history.

(56) References Cited

U.S. PATENT DOCUMENTS

| | | | | |
|---|---|---|---|---|
| 7,006,050 | B2 * | 2/2006 | Aisenbrey ..... | H01Q 1/364 343/791 |
| 2012/0040128 | A1 * | 2/2012 | Finn ..... | G06K 19/07783 428/96 |
| 2013/0075134 | A1 | 3/2013 | Finn | |

FOREIGN PATENT DOCUMENTS

| | | | |
|---|---|---|---|
| DE | 44 31 605 | A1 | 3/1996 |
| EP | 0 699 564 | A1 | 3/1996 |

(Continued)

OTHER PUBLICATIONS

International Search Report and Written Opinion mailed Dec. 23, 2014 in PCT Application No. PCT/US2014/055006.

*Primary Examiner* — Thiem Phan

(74) *Attorney, Agent, or Firm* — Christopher J. McKenna; Foley & Lardner LLP

(57) ABSTRACT

A method of forming a planar, low loss electrical component such as an inductor or transmission line is provided. A channel can be formed on a top surface of a substrate. A threading plate can be positioned on an upper surface of the channel. A wire or fiber can be introduced through the substrate, the channel, and the threading plate. The wire or fiber can then be guided into the channel using the threading plate. The substrate and the threading plate can then be removed.

18 Claims, 6 Drawing Sheets

(51) Int. Cl.
*H01B 13/06* (2006.01)
*H01F 5/04* (2006.01)

(56) References Cited

FOREIGN PATENT DOCUMENTS

| | | | |
|---|---|---|---|
| WO | WO-97/30418 | A2 | 8/1997 |
| WO | WO-2008/037579 | A1 | 4/2008 |

* cited by examiner

METHODS FOR FORMING CHIP-SCALE ELECTRICAL COMPONENTS

RELATED APPLICATIONS

The present application for Patent claims priority to U.S. Provisional Application No. 61/876,170, entitled "A METHOD TO FABRICATE LOW LOSS CHIP-SCALE RF INDUCTORS," filed Sep. 10, 2013, and assigned to the assignee hereof and hereby expressly incorporated by reference herein.

BACKGROUND

Several techniques have been proposed for improving the quality of chip-scale electrical components. However, many chip-scale components today are too lossy or too expensive for most applications, and as a result, larger surface-mount components are used more frequently. Therefore, there is a need for high quality chip-scale components that can be manufactured at relatively low cost.

SUMMARY OF THE INVENTION

Aspects and implementations of the present disclosure are directed to systems and methods for manufacturing low loss planar electronics components such as chip-scale inductors and transmission lines.

At least one aspect is directed to a method of forming an electronic component. The method includes obtaining a component substrate. The method includes forming a pattern including a channel on an upper surface of the component substrate. The method includes positioning a movable threading plate on an upper surface of the pattern. The method includes introducing a wire or fiber having a diameter less than or equal to about 200 microns through the threading plate. The method includes guiding the wire or fiber into the channel using the threading plate. The method includes forming at least one connection between the electronic component and at least one other electronic device.

In some implementations, the electronic component can be an inductor. In other implementations, the electronic component can be a transmission line. In some implementations, the wire or fiber can be a conductive wire formed from gold, silver, aluminum, or copper. In some implementations, the wire or fiber can be a multi-stranded wire.

In some implementations, the method can include removing the component substrate. In some implementations, the method can include removing the threading plate. In some implementations, the method can include depositing an adhesive into the channel. In some implementations, the method can include forming a hole through the component substrate. The method can include threading the wire or fiber through the hole in the component substrate.

In some implementations, forming the pattern on the upper surface of the component substrate can include forming the channel in the upper surface of the component substrate. In some implementations, forming the pattern on the upper surface of the component substrate can include forming the channel in a channel defining layer coupled to a surface of the component substrate. The channel defining layer can be formed from a polyimide material.

In some implementations, guiding the wire or fiber into the channel using the threading plate can include coupling the threading plate to an x-y stage and positioning the threading plate adjacent to the component substrate. The method can include controlling the x-y stage to move the threading plate relative to the component substrate such that a hole in the threading plate through which the wire or fiber is threaded traces a path along the channel, so that the threading plate pushes the wire or fiber into the channel as the hole in the threading plate traces the path along the channel.

In some implementations, guiding the wire or fiber into the channel using the threading plate can include coupling the component substrate to an x-y stage and positioning the threading plate adjacent to the component substrate. The method can include controlling the x-y stage to move the component substrate relative to the threading plate such that a hole in the threading plate through which the wire or fiber is threaded traces a path along the channel, so that the threading plate pushes the wire or fiber into the channel as the hole in the threading plate traces the path along the channel.

In some implementations, the component substrate can be an integrated circuit chip or a radiofrequency ceramic. In some implementations, the wire or fiber can have a substantially circular cross-section.

At least one aspect is directed to an electronic component. The electronic component includes a channel defining layer defining a channel having at least one curve within a plane. The electronic component includes a conductive wire having a diameter of less than or equal to about 200 microns positioned in the channel. The electronic component includes contact pads coupled to a surface of the electronic component opposite a surface in which the channel is defined. The contact pads are electrically coupled to respective ends of the conductive wire. In some implementations, the conductive wire can include gold, silver, aluminum, or copper. In some implementations, the wire can include a multi-stranded wire.

In some implementations, the electronic component can include a component substrate coupled to a surface of the channel defining layer. The component substrate can include a first hole and a second hole defined through the component substrate and the channel defining layer. The bond pads can be coupled to the respective ends of the conductive wire adjacent the first and second holes on a surface of the component substrate opposite the channel defining layer. In some implementations, the component substrate can include at least one of an integrated circuit chip and a radiofrequency ceramic.

In some implementations, the channel defining layer can be formed from a polyimide material. In some implementations, the conductive wire can be secured to the channel defining layer by an adhesive. In some implementations, the component can be an inductor. In some implementations, the conductive wire can have a substantially circular cross section.

BRIEF DESCRIPTION OF THE DRAWINGS

The accompanying drawings are not intended to be drawn to scale. Like reference numbers and designations in the various drawings indicate like elements. For purposes of clarity, not every component may be labeled in every drawing.

DESCRIPTION OF CERTAIN ILLUSTRATIVE IMPLEMENTATIONS

Following below are more detailed descriptions of various concepts related to, and implementations of, systems and methods for manufacturing a chip-scale electronic component. The various concepts introduced above and discussed in greater detail below may be implemented in any of numerous ways, as the described concepts are not limited to any particular manner of implementation. Examples of specific implementations and applications are provided primarily for illustrative purposes.

Figure 1:
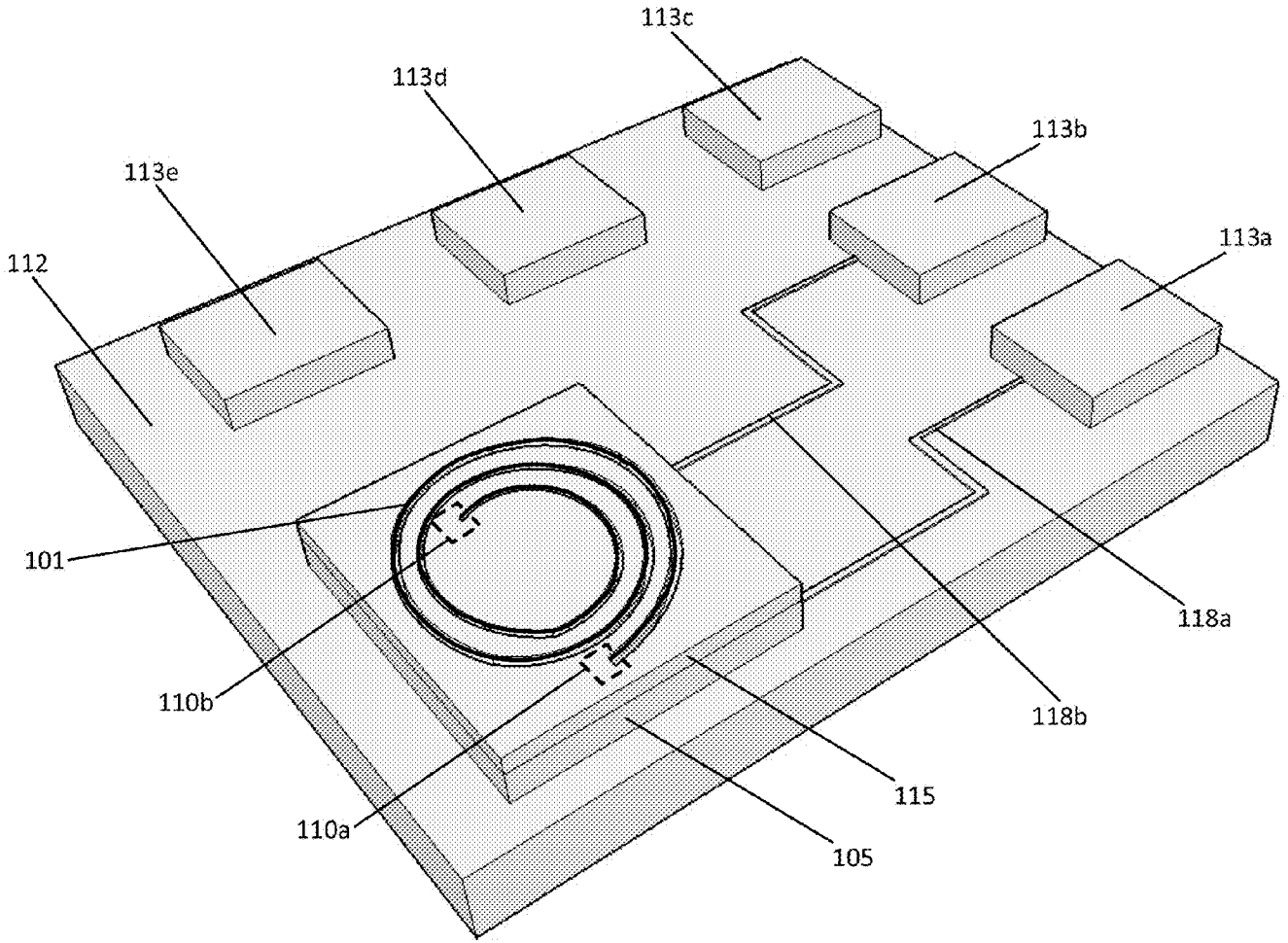
FIG. 1 is a perspective view of an electronic device including a chip-scale component, according to an illustrative implementation.

FIG. 1 is a perspective view of an electronic device 100 including a chip-scale component 101, according to an illustrative implementation. The component 101 is formed from a coil of wire or fiber threaded through a channel defined in a channel defining layer 115 and positioned on an upper surface of a component substrate 105. Contact pads 110*a* and 110*b* are placed on a lower surface of the component substrate 105, and are connected to the ends of the component 101 through the channel defining layer 115 and the component substrate 105. The contact pads 110*a* and 110*b* are shown in broken lines, because they are positioned behind the channel defining layer 115 and the component substrate 105 in the perspective view shown in FIG. 1. In some implementations, the component 101 can be an inductor or an electrical transmission line. In some other implementations, the component 101 can be a fiber optic transmission line.

The device 100 also includes a second substrate 112. The second substrate 112 includes five electronic devices 113*a*-113*e* (generally referred to as electronic devices 113) mounted on its upper surface. A conductive trace 118*a* electrically connects the electronic device 113*a* to the contact pad 110*a* placed on the lower surface of the component substrate 105. A conductive trace 118*b* electrically connects the contact pad 110*b* to the electronic device 113*b*.

The component 101 is formed from a conductive wire or a fiber that has been shaped into a spiral pattern. Such a pattern can be useful for implementations in which the component 101 is an inductor or other device having magnetic properties. While the component 101 is shown in FIG. 1 as including 2.5 turns, it should be understood that other patterns may be used. For example, the component 101 may be shaped as a spiral including any length of wire or fiber, any number of turns, and any radius of curvature. In some implementations, the component 110 may have other shapes. For example, the component 110 may follow a meandering path having one or more curves that allow energy to be stored in a magnetic field when current passes through the component 101. In some implementations, the shape of the component 101 can be selected to achieve a desired inductance.

In some implementations, the component 101 can be formed from a thin wire, such as wire typically used to link components in integrated circuit devices (often referred to as "bond wire"). For example, the wire used to form the component 101 may have a diameter in the range of about 10 microns to about 500 microns. In some implementations, the wire has a diameter of less than about 200 microns. To improve quality, the wire can include materials having low electrical resistances, such as gold, silver, aluminum, or copper. In some other implementations, the wire may be formed from insulated magnet wire. An insulating coating surrounding the wire can be removed from the ends of the component 101 to facilitate electrical connections between the component 101 and the contact pads 110*a* and 110*b*. In some implementations, an insulating coating may be removed from the entire length of the wire used to form the component 101. In some other implementations, the wire can be a magnet wire or optical fiber having similar diameter. In some instances, the wire may be multi-stranded and heterogeneous, such as braided "Litz" wire. A substantially circular cross-sectional shape of the wire used to form the component 101 can also improve quality of the component 101, relative to other cross-sectional shapes that are sometimes used to form chip-scale or surface mount components.

For example, chip-scale and surface mount inductors are often formed as electroplated structures that can be fabricated using MEMS processing techniques to achieve relatively small feature sizes. However, due to limitations inherent in MEMS fabrication processes, electroplated structures typically have square or rectangular cross-sectional shapes. As a result, these inductors typically do not achieve high quality factors (a ratio of inductive reactance to resistance for a given frequency). This is due in part to the current crowding effects that exist when electrical current is passed through an inductor having a rectangular cross-section. Generally, in such an inductor, a disproportionate amount of electrical charge accumulates in the sharp corners of the conductive material used to form the inductor, which leads to higher resistances and lower quality factors for these inductors. In implementations in which the component 101 is an inductor, these problems can be mitigated by forming the component 101 using wire with a substantially circular cross-section along its length, which leads to lower resistance and a higher quality factor.

Typical wire bonding techniques commonly used to form electrical connections using bond wire are also suboptimal for forming an inductor. For example, wedge bonding, ball bonding, and stitch bonding can be used to shape a bond wire into a meandering path forming an inductor. However, inductors formed using these techniques have a deformed cross-section at positions where the bonder tacks the wire to the substrate, degrading the electrical characteristics of the component (e.g., its quality factor). This is because these bonding techniques use pressure or heat to make a weld at each connection point, and the bond wire is typically flattened in the region of each weld. A process that can be used to shape bond wire (or other wire or fiber of similar diameter) into an appropriate shape for forming the component 101 while maintaining substantially circular cross-sections at all or substantially all points along the length of the component 101 is described below in connection with FIG. 2.

The lower surface of the component substrate 105 is in contact with the upper surface of the second substrate 112. The contact pads 110*a* and 110*b* can be positioned so that they are aligned with the leads 118*a* and 118*b*, respectively, formed on the second substrate 112, creating an electrical path through the component 101 to the leads 118*a* and 118*b*. This configuration allows the component 101 to be electrically connected to the electronic devices 113*a* and 113*b*. In some implementations, the upper surface of the substrate 112 may include contact pads opposed to the contact pads 110*a* and 110*b* formed on the component substrate 105, to allow for a better electrical connection between the component 101 and the leads 118*a* and 118*b*. In some implementations, the second substrate 112 may include additional electronic devices 113, and the inductor may be configured to be electrically coupled to an arbitrary number of the electronic devices 113. Some of the electronic devices 113, such as the electronic devices 113*c*-113*e*, may remain electrically isolated from the component 101.

In some implementations, the electronic devices 113 may be passive components, such as resistors, capacitors, or inductors. In other implementations, the electronic devices may be integrated circuits including a combination of active and passive components. Additional electronic devices may also be positioned on the upper or lower surface of the component substrate 105. In some implementations, the component 101 may can be formed on the component substrate 105 and the channel defining layer 115 before the component substrate 105 and the channel defining layer 115 are positioned on the substrate 112. After the component 101 is formed, the component substrate 105 and the channel defining layer 115 can be transferred to the substrate 112. For example, a pick-and-place machine can be used to position the component substrate 105 and the channel defining layer 115 over the substrate 112 and secure the component substrate 105 to the substrate 112. In some implementations, the substrate 112 may include multiple instances of the component 101.

Figure 2:
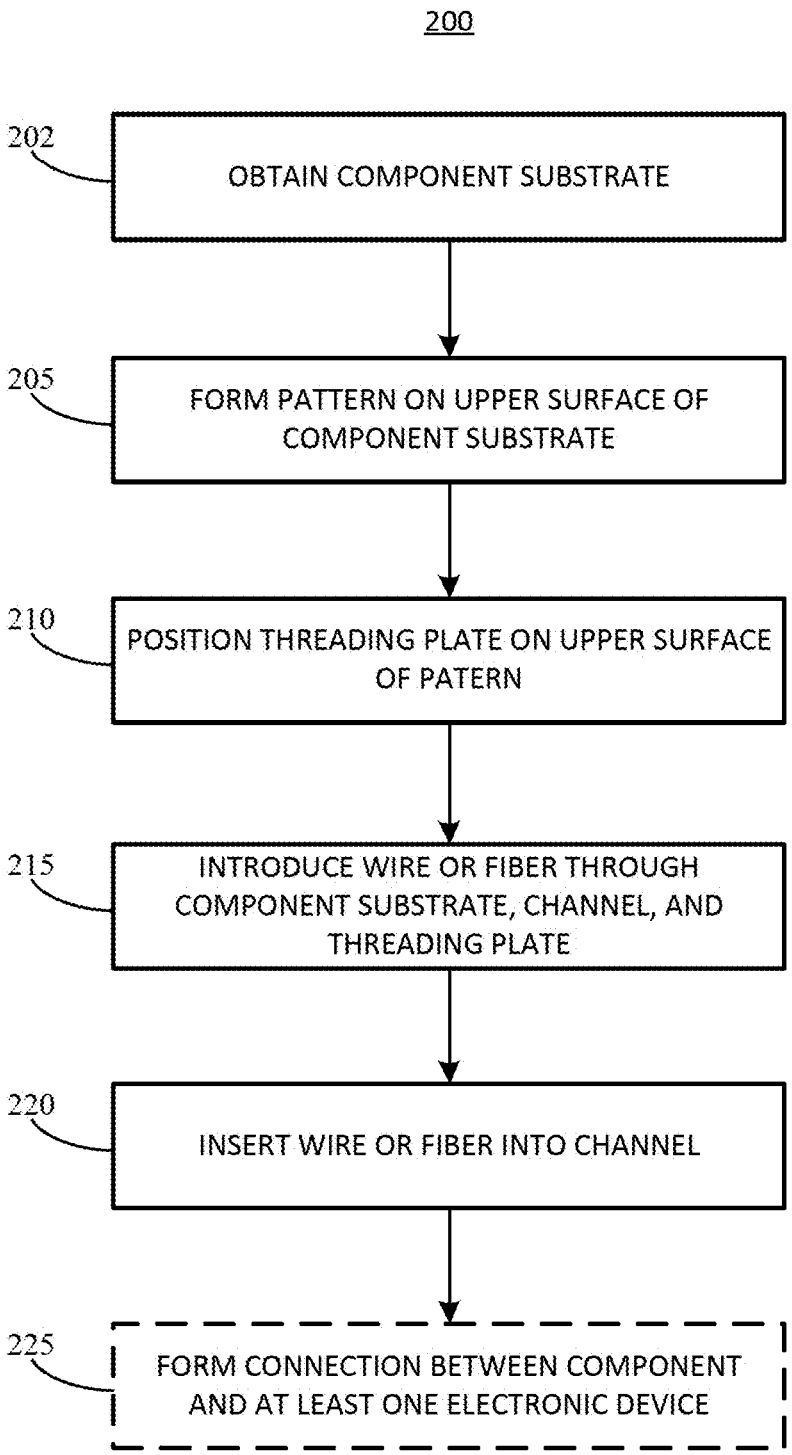
FIG. 2 is a flow diagram of a process for forming the chip-scale component shown in FIG. 1, according to an illustrative implementation.

FIG. 2 is a flow diagram of a process 200 for forming the electronic component 101 shown in FIG. 1, according to an illustrative implementation. In brief overview, the process 200 includes obtaining a component substrate (stage 202) and forming a pattern on an upper surface of the component substrate (stage 205). A threading plate is positioned on an upper surface of the pattern (stage 210). Wire or fiber is introduced through the component substrate (stage 215), and the wire or fiber is guided into a channel defined by the pattern (stage 220). In some implementations, a connection is then formed between the electronic component and one or more additional electronic devices (stage 225). The process 200 shown in FIG. 2 is described in connection with FIGS. 3A and 3D below.

Figure 3A:
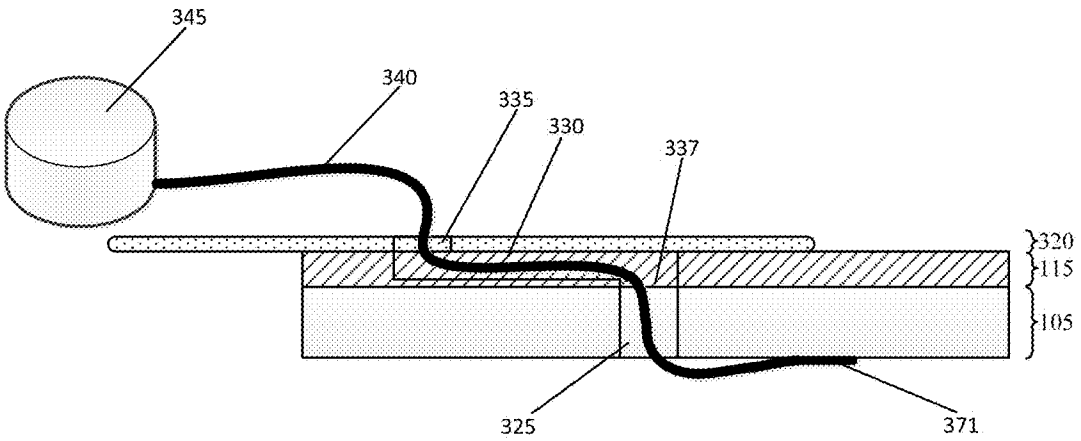
FIG. 3A is a cross-sectional view of a component substrate, a channel defining layer, and a threading plate used in the process shown in FIG. 2, according to an illustrative implementation.
Figure 3B:
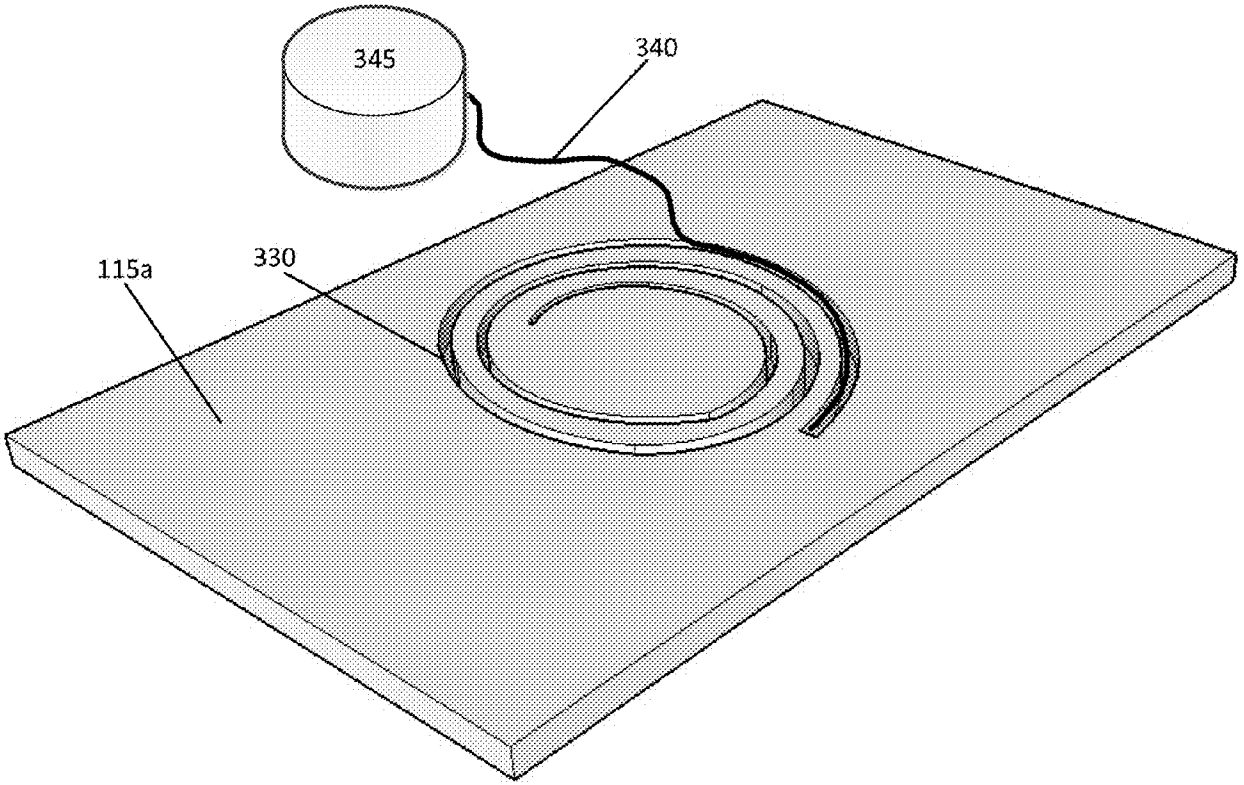
FIG. 3B is a perspective view of a first example implementation of the channel defining layer shown in FIG. 3A.
Figure 3C:
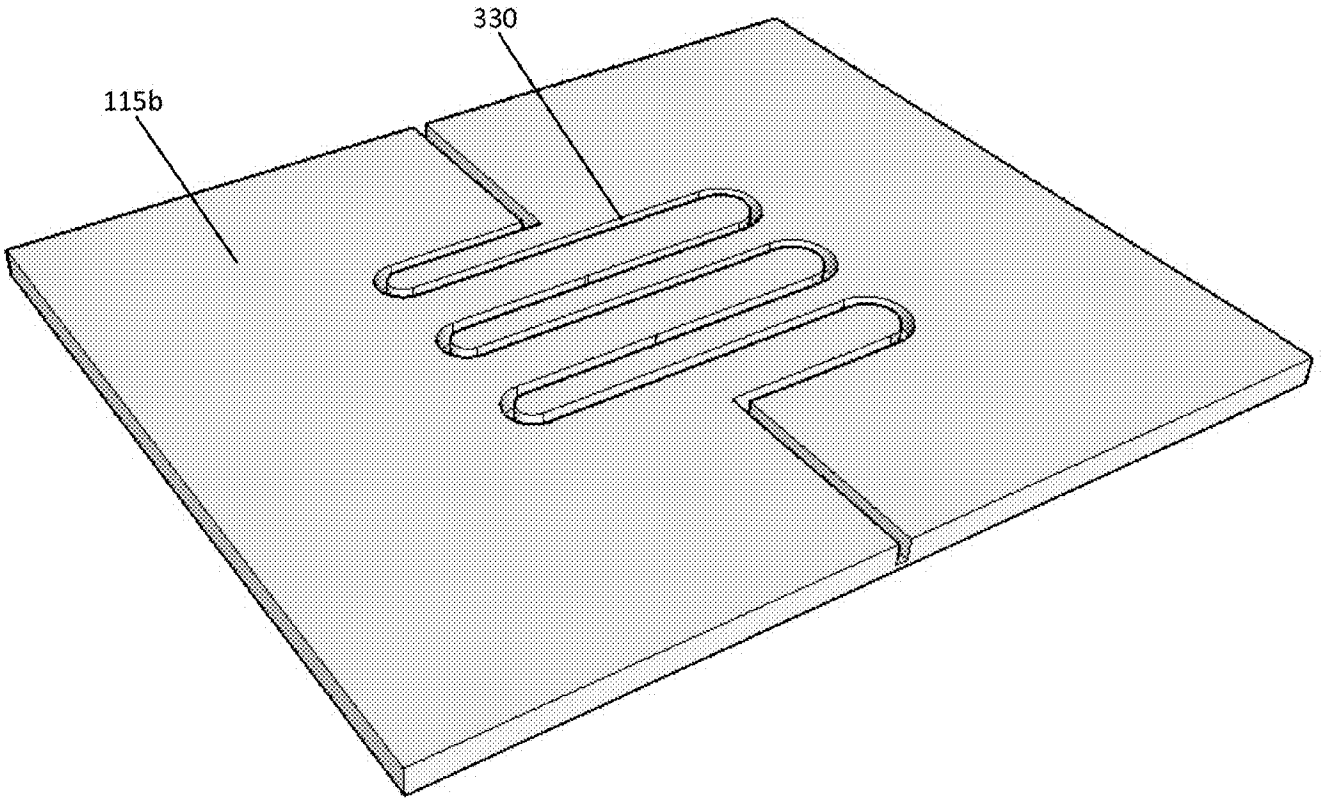
FIG. 3C is a perspective view of a second example implementation of the channel defining layer shown in FIG. 3A.
Figure 3D:
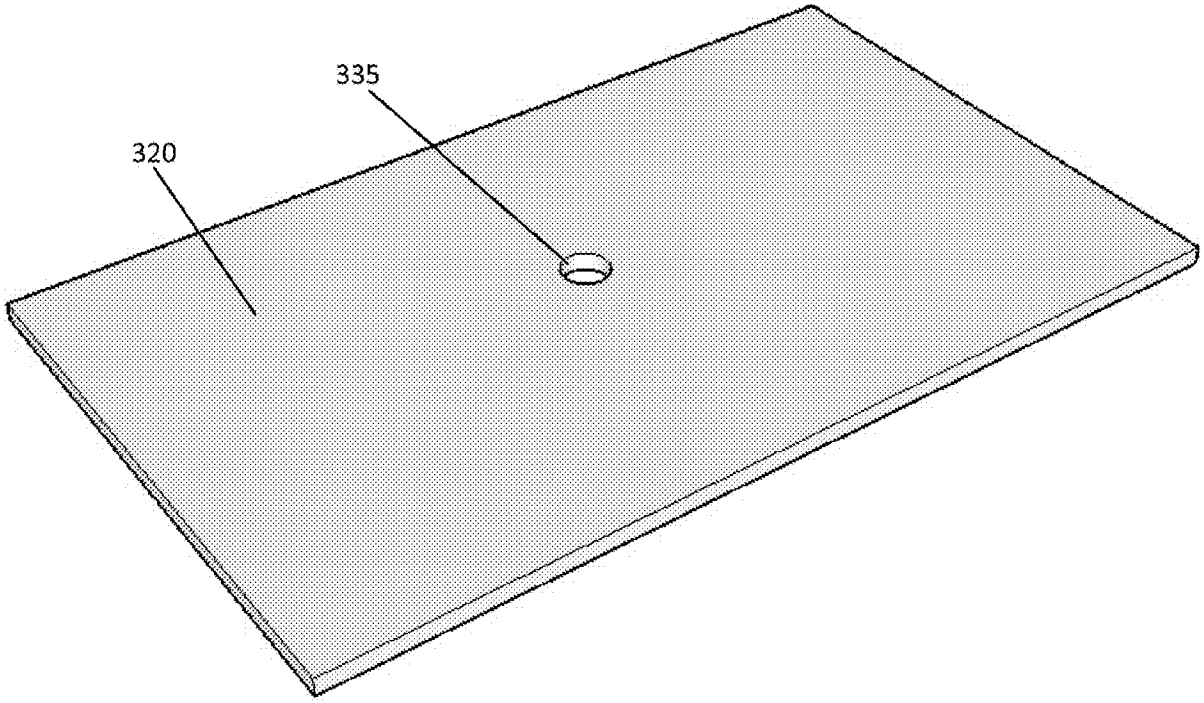
FIG. 3D is a perspective view of a threading plate that can be used in the fabrication of the chip-scale component shown in FIG. 1, according to an illustrative implementation.

FIGS. 3A-3D show various views of the components used in the process 200. FIG. 3A is a cross-sectional view of inductor component substrate 105, a channel defining layer 115, and a threading plate 320 used in the process 200 shown in FIG. 2, according to an illustrative implementation. FIG. 3B is a perspective view of a first example implementation of the channel defining layer 115*a* that can be used as the channel defining layer 115 shown in FIG. 3A. FIG. 3C is a perspective view of a second example channel defining layer 115*b* that can be used as the channel defining layer 115 shown in FIG. 3A. FIG. 3D is a perspective view of the threading plate 320 shown in FIG. 3A, which can be used in the fabrication of the chip-scale component 101 shown in FIG. 1, according to an illustrative implementation.

The process 200 begins with obtaining the component substrate 105 (stage 202). Generally, the component substrate 105 can be formed from an insulating material, such as glass or ceramic. In some implementations, the component substrate 105 can be an insulating surface of an integrated circuit or a radiofrequency ceramic. The process 200 includes forming a pattern on an upper surface of the component substrate 105 (stage 205). In some implementations, the pattern can be formed in a channel defining layer 115, as shown in the cross-sectional view of FIG. 3A. The channel defining layer can be directly bonded to the component substrate 105, or it can be coupled to the component substrate via an intervening release layer than be chemically or thermally broken down to later separate the channel defining layer 115 from the component substrate 105. The pattern can be formed by etching a channel corresponding to the desired shape of the electronic component into the channel defining layer 115. A first example channel defining layer 115*a* is shown in FIG. 3B. As shown, the channel defining layer 115*a* includes a spiral shaped channel 330 formed at its center. In some implementations, the channel defining layer 115*a* can have a thickness in the range of about 0.1 millimeters to about 1 millimeter and can be formed from a polyimide material, such as kapton. In some implementations, the channel defining layer 115*a* can have a thickness of about 0.25 millimeters. The width of the channel 330 can be selected to be between a width slightly larger (e.g., about 5-10 microns wider) than the width of the wire 340 that will form the electronic component 101, and up to two times the width of the wire 340. This allows the wire 340 to be inserted into the channel 330. In some implementations, the channel 330 can have a depth that is at least about the diameter of the wire 340.

In some implementations, the channel 330 can be formed using a milling machine. For example, if the desired width of the channel 330 is larger than about 30 microns, a mechanical milling machine can be used to etch the channel into the substrate 115*a*. In implementations in which the desired width of the channel 330 is less than about 30 microns, the channel can be formed using MEMS processes that typically have smaller minimum feature sizes than milling machines.

In some implementations, the channel 330 may extend to one or more edges of the channel defining layer 115. An example of a channel defining layer 115*b* including such a channel 330 is shown in FIG. 3C. As shown, the channel 300 of the channel defining layer 115*b* is formed in a meandering path that begins on a first edge of the channel defining layer 115*b* and ends on an opposite edge of the channel defining layer 115*b*. This arrangement of the channel 330 can allow the process 200 to be simplified, as discussed further below in connection with stage 215 of the process 200.

In other implementations, the channel 330 can be formed directly in an upper surface of the component substrate 105. For example, the pattern may be etched into the component substrate 105 or the second substrate 112 using a milling machine or a MEMS fabrication process, so that the channel 330 is formed directly in the upper surface of the component substrate 105 or second substrate 112, eliminating the need for a separate channel defining layer 115 (and in some cases the component substrate 105).

The process 200 includes positioning a threading plate 320 on an upper surface of the pattern (stage 215). The threading plate 320, shown in the perspective view of FIG. 3D, can be used to guide the wire 340 into the channel 330. As shown, the threading plate 320 is a planar surface in which a hole 335 has been formed. The hole 335 can have a circular cross-sectional shape or any other cross-sectional shape selected to not put undue stress or friction on the wire 340 passing through the hole 335. In some implementations, the threading plate 320 can be formed from a transparent material, so that the wire 340 can be viewed through the surface of the threading plate 320 as the wire is inserted into the channel 330, as discussed below.

The process 200 includes introducing a wire or fiber through the component substrate 105, the channel 330, and the threading plate 320 (stage 215). As shown in FIG. 3A, a wire 340 can be secured to the lower surface of the component substrate 105 at the point labeled 371, and can be threaded through a hole 325 formed in the component substrate 105, through a hole 337 formed in the channel defining layer 115, and through the hole 335 formed in the threading plate 320. The wire 340 is shown attached to a spool 345. In some implementations, the wire 340 can be bonded to the point labeled 371 after the threading of the wire through the channel 330 is complete. Although this description process 200 refers primarily to manipulation of a wire 340, the principles also apply to implementations in which the wire 340 shown in FIG. 3A is replaced by a non-metallic material, such as a fiber optic cable. In some implementations, the wire 340 may be a single strand wire, a multithreaded wire in which the individual strands are twisted or braided, or a fiber optic cable. In some implementations, the wire 340 may be formed form a conductive material, such as gold, silver, aluminum, or copper. In other implementations, the wire 340 may be formed from a semiconducting material. In still other implementations, the wire 340 can be a magnetic wire.

In some implementations, it may be desirable to avoid forming the hole 325 through the component substrate 105. For example, the structural integrity of the component substrate 105 may be more readily preserved if the hole 325 is not included. In such an implementation, an alternative channel defining layer 115, such as the channel defining layer 115*b* shown in FIG. 3B, may be used. Because the channel 330 formed in the channel defining layer 115*b* extends to the edges of the channel defining layer 115*b*, the conductive wire 340 can be fed into and out of the channel 330 from the edges rather than through a hole. Therefore, when the channel defining layer 115*b* is place on top of the component substrate 105, the wire 340 can be introduced into the channel 330 formed in the channel defining layer 115*b* without first forming a hole through the component substrate 105.

The process 200 includes guiding the wire 340 into the channel 330 (stage 220). This can be accomplished by using the threading plate 320 to direct the wire 340 around the path of the channel 330. For example, the threading plate 320 can be moved around the surface of the channel defining layer such that the hole 335 formed in the threading plate 320, through which the wire 340 has been threaded, travels along the path of the channel 330. FIGS. 3A and 3B show the wire 340 partially inserted into the channel 330. For illustrative purposes, the threading plate 320 is not shown in FIG. 3B. The wire 340 is gradually guided into the channel 330 along the length of the channel 330.

In some implementations, the threading plate 320 can be positioned by hand as the wire 340 is inserted into the channel 330. In other implementations, the threading plate 320 can be coupled to an x-y stage, and the x-y stage can be controlled to move the threading plate 320 adjacent to the channel defining layer 115 along the path of the channel 330. In still other implementations, the threading plate 320 can remain stationary while the component substrate 105 and the channel defining layer 115 are moved adjacent the threading plate 320. After the wire 340 has been inserted along the entire length of the channel 330, the wire 340 can be fed back through the component substrate 105 and coupled to the contact pad 110*b* shown in FIG. 1. In some implementations, the wire 340 can be inserted back through a second hole formed in the component substrate 105 using an air gun, tweezers, or a vacuum.

In some implementations, an adhesive material such as a wicking glue may be inserted into the channel 330 to secure the wire 340 within the channel 330. In other implementations, the wire 340 may be secured within the channel 330 without the use of an adhesive. For example, some processes used for forming the channel 330 in the channel defining layer 115, such as milling, may result in rough edges along the upper surface of the channel 330, with burrs extending over the edges of the channel 330. These burrs may be sufficient for preventing the wire 340 from slipping out of the channel 330.

In some implementations, the component substrate 105 and the threading plate 320 can then be removed, leaving the electronic component 101 within the channel defining layer 115. As indicated above, in some implementations, a release layer may be positioned between the component substrate 105 and the channel defining layer 115. The release layer can help to facilitate separating the component substrate 105 from the channel defining layer 115 after the electronic component 101 is formed. In other implementations, the component substrate 105 and the channel defining layer 115 can remain attached to one another, as shown in FIG. 1. In some implementations, the threading plate 320 can remain over the channel defining layer 115, which can help to secure the wire within the channel defining layer 115.

Guiding the wire 340 into the channel 330 according to the process 200 can produce an electrical component 101 having electrical characteristics that are superior to those of components that are shaped using other techniques. For example, as discussed above, maintaining a circular cross-section reduces the resistance through the wire 340, which results in a higher quality factor when the process 200 is used to form an inductor. Similarly, when the process 200 is used to form an electrical transmission line, the reduced electrical resistance can make transmission of electrical power more efficient. It may not be possible to achieve these results using MEMS fabrication techniques or traditional wire bonding techniques, which typically result in structures having cross-sections with sharp corners. The process 200 can also be used to form a transmission line using a fiber optic cable rather than a wire. In such an example, the process 200 can be advantageous because it does not require the fiber optic cable to be crimped or bent at sharp angles, which could interfere with the functionality of the fiber optic cable.

In some implementations, the process 200 may include forming at least one connection between the electronic component 101 and at least one other electronic device (stage 225). For example, the ends of the wire 340 can be secured to electrical contact pads on a lower surface of the component substrate 105, such as the contact pads 110*a* and 110*b* shown in FIG. 1. The electronic component 101 can then be placed on another substrate, such as the substrate 112 shown in FIG. 1, such that the contact pads 110*a* and 110*b* are electrically connected to the leads 118*a* and 118*b*, respectively. The electronic component 101 can be connected to the electronic devices 113*a* and 113*b* via the leads 118*a* and 118*b*. In other implementations, the electronic component may be connected to other electronic devices by a fiber optic cable.

In some implementations, a low loss inductive element may be formed, but no direct electrical connection may be necessary. For example, metamaterial and frequency selective surfaces can be formed from sub-wavelength resonant elements such as split ring resonators. Although these can be constructed using other methods, the construction of these surfaces by using the process 200 to make the low-loss elements can improve their performance. In these implementations, it may not be necessary or desirable to form a direct electrical connection to the electrical component that forms an element of the metamaterial.

Having now described some illustrative implementations, it is apparent that the foregoing is illustrative and not limiting, having been presented by way of example. In particular, although many of the examples presented herein involve specific combinations of method acts or system elements, those acts and those elements may be combined in other ways to accomplish the same objectives. Acts, elements and features discussed only in connection with one implementation are not intended to be excluded from a similar role in other implementations.

The systems and methods described herein may be embodied in other specific forms without departing from the characteristics thereof. The foregoing implementations are illustrative rather than limiting of the described systems and methods. Scope of the systems and methods described herein is thus indicated by the appended claims, rather than the foregoing description, and changes that come within the meaning and range of equivalency of the claims are embraced therein.

What is claimed is:

1. A method of fabricating an electronic component, the method comprising:

obtaining a component substrate;

forming a pattern including a channel on an upper planar surface of the component substrate;

positioning a movable threading plate on an upper surface of the pattern, the threading plate including a planar surface that covers at least a portion of the upper planar surface of the component substrate;

introducing a wire or fiber having a diameter less than or equal to about 200 microns through the threading plate; and guiding the wire or fiber into the channel using the threading plate.

2. The method of claim 1, further comprising forming at least one connection between the electronic component and at least one other electronic device.

3. The method of claim 1, wherein the electronic component is an inductor.

4. The method of claim 1, wherein the electronic component is a transmission line.

5. The method of claim 1, wherein the wire or fiber comprises a conductive wire formed from at least one of gold, silver, aluminum, and copper.

6. The method of claim 1, wherein the wire or fiber comprises a multi-stranded wire.

7. The method of claim 1, further comprising removing the component substrate.

8. The method of claim 1, further comprising removing the threading plate.

9. The method of claim 1, further comprising depositing an adhesive into the channel.

10. The method of claim 1, further comprising forming a hole through the component substrate.

11. The method of claim 1, further comprising threading the wire or fiber through the hole in the component substrate.

12. The method of claim 1, wherein forming the pattern on the upper surface of the component substrate comprises forming the channel in the upper surface of the component substrate.

13. The method of claim 1, wherein forming the pattern on the upper surface of the component substrate comprises forming the channel in a channel defining layer coupled to a surface of the component substrate.

14. The method of claim 13, wherein the channel defining layer is formed from a polyimide material.

15. The method of claim 1, wherein guiding the wire or fiber into the channel using the threading plate comprises:

coupling the threading plate to an x-y stage;

positioning the threading plate adjacent to the component substrate; and controlling the x-y stage to move the threading plate relative to the component substrate such that a hole in the threading plate through which the wire or fiber is threaded traces a path along the channel, such that the threading plate pushes the wire or fiber into the channel as the hole in the threading plate traces the path along the channel.

16. The method of claim 1, wherein guiding the wire or fiber into the channel using the threading plate comprises:

coupling the component substrate to an x-y stage;

positioning the threading plate adjacent to the component substrate; and controlling the x-y stage to move the component substrate relative to the threading plate such that a hole in the threading plate through which the wire or fiber is threaded traces a path along the channel, such that the threading plate pushes the wire or fiber into the channel as the hole in the threading plate traces the path along the channel.

17. The method of claim 1, wherein the component substrate comprises one of an integrated circuit chip and a radiofrequency ceramic.

18. The method of claim 1, wherein the wire or fiber has a substantially circular cross-section.

* * * * *